US006817394B2

(12) United States Patent
Kitazawa et al.

(10) Patent No.: US 6,817,394 B2
(45) Date of Patent: Nov. 16, 2004

(54) PRISMATIC WOOD COMPRESSION MOLDING METHOD AND COMPRESSION MOLDING DEVICE THEREFOR

(75) Inventors: Kimiyoshi Kitazawa, Nagano (JP); Yorikuni Shibuya, Nagano (JP)

(73) Assignees: Japan as represented by Director General of Agency of Shinshu University, Matsumoto (JP); Yoshikawa Kensetsu Kabushiki Kaisha, Iida (JP)

( * ) Notice: Subject to any disclaimer, the term of this patent is extended or adjusted under 35 U.S.C. 154(b) by 0 days.

(21) Appl. No.: 10/031,750

(22) PCT Filed: Feb. 20, 2001

(86) PCT No.: PCT/JP01/01215

§ 371 (c)(1),
(2), (4) Date: May 16, 2002

(87) PCT Pub. No.: WO01/89780

PCT Pub. Date: Nov. 29, 2001

(65) Prior Publication Data

US 2002/0148532 A1 Oct. 17, 2002

(30) Foreign Application Priority Data

May 24, 2000 (JP) ..... 2000-153153

(51) Int. Cl.[7] ..... B27M 1/02

(52) U.S. Cl. ..... 144/361; 144/380; 144/271; 144/2.1

(58) Field of Search ..... 144/361, 380, 144/2.1, 359, 271; 264/405, 489, 231, 320, 322, 319

(56) References Cited

U.S. PATENT DOCUMENTS 1,403,722 A * 1/1922 Turnbull ..... 144/361
4,469,156 A * 9/1984 Norimoto et al. ..... 144/380
5,343,913 A * 9/1994 Tanahashi et al. ..... 144/380

FOREIGN PATENT DOCUMENTS

| | | | |
|---|---|---|---|
| JP | 5-50409 A | | 3/1993 |
| JP | 5-50409 | * | 3/1993 |
| JP | 05-050409 | * | 3/1993 |
| JP | 6-234104 A | | 8/1994 |
| JP | 06-234104 | | 8/1994 |
| JP | 07-195309 | | 8/1995 |
| JP | 7-195309 A | | 8/1995 |
| JP | 7-195311 | * | 8/1995 |
| JP | 09-277211 | | 10/1997 |
| JP | 9-295302 A | * | 11/1997 |
| JP | 09-295302 | | 11/1997 |
| JP | 9-295302 | * | 11/1997 |
| JP | 10-113908 | | 5/1998 |
| JP | 11-114918 A | | 4/1999 |
| JP | 11-114918 | | 4/1999 |
| JP | 11-291207 | | 10/1999 |
| JP | 11-291207 A | | 10/1999 |
| JP | 2000-141320 A | | 5/2000 |
| JP | 2000-141320 | | 5/2000 |

* cited by examiner

*Primary Examiner*—Allen Ostrager
*Assistant Examiner*—Shelley Self
(74) *Attorney, Agent, or Firm*—Birch, Stewart, Kolasch & Birch, LLP

(57) ABSTRACT

A prismatic wood compression molding method capable of easily producing long-sized lumber usable as pillars or like by compression molding. The method is characterized by comparing the steps of: using a plurality of rigid plate-like bodies such as metal plates to compress an outer face of wood throughout length thereof to compression-mold it into prismatic wood which is polygonal, such as rectangular or hexagonal, in cross section; restraining the plate-like bodies by a restraining jig so as to hold flat surfaces of the prismatic wood in a state in which they are compressed by the plate-like bodies; and applying a heat treatment to the prismatic wood held in the compressed state by the plate-like bodies and the jig so as to permanently fix the shape of the prismatic wood.

19 Claims, 18 Drawing Sheets

PRISMATIC WOOD COMPRESSION MOLDING METHOD AND COMPRESSION MOLDING DEVICE THEREFOR

This application is the national phase under 35 U.S.C. §371 of PCT International Application No. PCT/JP01/01215 which has an International filing date of Feb. 20, 2001, which designated the United States of America.

FIELD OF TECHNOLOGY

The present invention relates to a prismatic wood compression molding method, more precisely relates to a prismatic wood compression molding method, in which prismatic wood having a polygonal sectional shape, e.g., rectangular, hexagonal, is formed by compressing wood, the compressed state of the wood is maintained and the compressed wood is heat-treated so as to permanently fix the prismatic shape of the compressed wood.

BACKGROUND TECHNOLOGY

Conventionally, compressed lumber is manufactured by the steps of: compressing wood, e.g., needle-leaf wood; accommodating the compressed wood in a container; and heating the compressed wood by introducing steam into the container so as to permanently fix the shape of the compressed wood whose hardness is almost equal to that of broadleaf wood.

To heat-treat the wood in the container by steam, the container must be a pressure container, it is difficult to simultaneously treat a large amount of wood in a large container, and manufacturing efficiency must be lower.

Japanese Patent Gazette No. 7-47511 disclosed a method of permanently fixing a shape of compressed wood, the method comprises the steps of: compressing raw wood, whose water content is about 20 %, by a compressing die set; air-tightly accommodating the compressed wood in a container, in which a clearance is formed between the compressed wood and an inner face thereof; and heating the compressed wood in the container.

DISCLOSURE OF THE INVENTION

In the method disclosed in the Japanese patent gazette, the compressed wood is wet-heated by using water included in the wood, so that the compressed shape can be fixed in a short time. In comparison with the method in which the wood in the pressure container is heated by introducing steam thereunto, the wood can be compressed and the compressed shape thereof can be permanently fixed by a simple facility.

However, in the method disclosed in the Japanese patent gazette, the wood is compressed by the compressing die set, then the compressed wood is heat-treated in the die set.

If the wood to be compressed is longer than the compressing die set, it is difficult to compress the wood throughout length thereof, therefore size of the die set for compressing long wood must be large. So size of the wood depends on the size of the compressing die set.

In the case of heating the raw wood whose water content is about 20%, vapor is emitted while heating; the compressing die set must be made of stainless steel, so that the compressing die set must be expensive and manufacturing cost of the compressed lumber must high.

Generally, length of prismatic pillars for wooden building are several meters, so it is very difficult to compress long wood by the method disclosed in the Japanese patent gazette due to size of the compressing die set and the manufacturing cost.

A fist object of the present invention is to provide a prismatic wood compression molding method capable of easily manufacturing compressed prismatic wood for pillars, etc.

A second object of the present invention is to provide a compression molding device for executing said method.

The inventors of the present invention have studied and found that rectangular wood can be formed by compressing wood with four rigid metal plates whose length is equal to that of the wood and that the metal plates can compress the wood throughout the length thereof by pressing center portions of the metal plates by an upper die and a lower die of a compressing die set.

Further, the inventors found that a band-shaped member clamping the four metal plates, which compress flat outer faces of the compressed wood, is capable of maintaining the compressed state of the wood after the compressing die set releases the compressed wood, and that the compressed shape of the wood can be permanently fixed by applying a heat treatment to the prismatic wood which has been compressed by the four metal plates and the band-shaped member.

To achieve the first object of the present invention, the prismatic wood compression molding method comprises the steps of: compressing an outer circumferential face of wood throughout of length of the wood by a plurality of rigid plate-like bodies such as metal plates to form into prismatic wood which is polygonal, such as rectangular or hexagonal, in cross section; restraining the plate-like bodies by a restrain jig so as to hold flat surfaces of the prismatic wood in a state in which they are compressed by the plate-like bodies; and applying a heat treatment to the prismatic wood held in the compressed state by the plate-like bodies and the jig so as to permanently fix the shape of the prismatic wood.

To achieve the second object of the present invention, the compression molding device for manufacturing compressed prismatic lumber comprises: a compression molding die set including an upper die and a lower die, which form a cavity, which is polygonal such as rectangular or hexagonal, when they are closed; a plurality of plate-like bodies, such as metal plates, compressing an outer circumferential face of wood throughout of length thereof so as to form into prismatic wood which is polygonal, such as rectangular or hexagonal, in cross section; and a restraint jig restraining the plate-like bodies so as to hold flat surfaces of the prismatic wood in a state in which they are compressed.

Further, the second object of the present invention can be achieved by the compression molding device for manufacturing compressed prismatic lumber comprising: a compression molding die set for compressing an outer circumferential face of wood so as to form into prismatic wood which is polygonal, such as rectangular or hexagonal, in cross section; and a cylindrical die having transverse sectional shape, which is polygonal such as rectangular or hexagonal, corresponding to that of the prismatic wood, wherein an outlet of the compression molding die set and an inlet of the cylindrical die are arranged close so as to insert the compressed wood into the cylindrical die.

In the present invention, a plurality of the rigid plate-like bodies such as metal plates respectively compress the outer flat faces of the compressed wood, the restraining jig restrains the plate-like bodies to maintain the compressed state, then the compressed prismatic wood is heat-treated.

Therefore, the compressed wood can be taken out from the compressing die set and heat-treated, so the compressing die set need not be installed in heat-treating atmosphere. So the compressing die set can be made of steel, which is more inexpensive than stainless steel.

Since the wood is directly compressed by the plate-like bodies, length of the plate-like bodies can be selected on the basis of length of the wood. Even if the wood is longer than the compressing die set, the plate-like bodies which contact the wood throughout length thereof are partially pressed by the inner faces of the cavity of the dies of the compressing die set, so that long compressed lumber having a prismatic sectional shape can be manufactured.

Further, the compressed state can be maintained by inserting the compressed prismatic wood in the cylindrical die whose sectional shape is polygonal shape. By applying the heat treatment to the compressed prismatic wood, the prismatic shape of the wood can be permanently fixed. Namely, long compressed prismatic wood can be easily manufactured by the long prismatic cylindrical die.

THE BEST EMBODIMENTS OF THE INVENTION

Figure 1A:
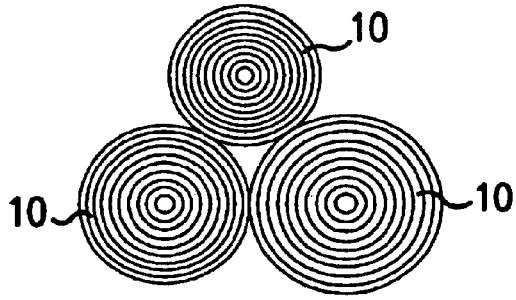
FIGS. 1A–1C are explanation views showing the steps of manufacturing the prismatic lumber of an embodiment of the present invention.
Figure 1B:
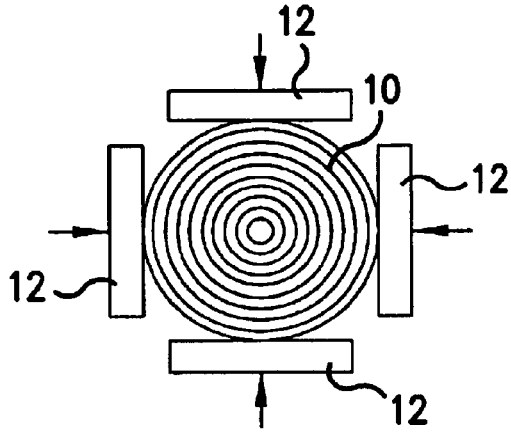

An example of the prismatic wood compression molding method of the present invention will be explained with reference to FIGS. 1A–1C and 2. In the method shown in FIGS. 1A–1C, 2A and 2B, a log 10 shown in FIG. 1A is compressed as wood to be compressed. The log 10 may have bark. As shown in FIG. 1B, metal plates 12 are arranged to enclose and contact the log 10, and the length of the metal plates are equal to that of the log. The metal plates 12 are respectively pressed by external force shown by arrows (directions perpendicular to the metal plates 12) shown in FIG. 1B, so that the outer circumferential face of the log 10 is compressed and formed into a prismatic shape.

The metal plates 12 are rigid plates, so the metal plates 12 are not deformed by the external force.

As shown in FIG. 1B, a two-axis compressing die set shown in FIG. 2 may be used so as to press the metal plates 12, 12 . . . and form the log 10 into the prismatic shape. The two-axis compressing die set comprises: an upper die 24 fixed to a movable plate 20 capable of moving in the vertical direction; a lower die 26 fixed to a fixed plate 22; and a pair of side dies 28 and 28 which are moved in the right-left direction by the upper die 24 and the lower die 26.

Figure 2A:
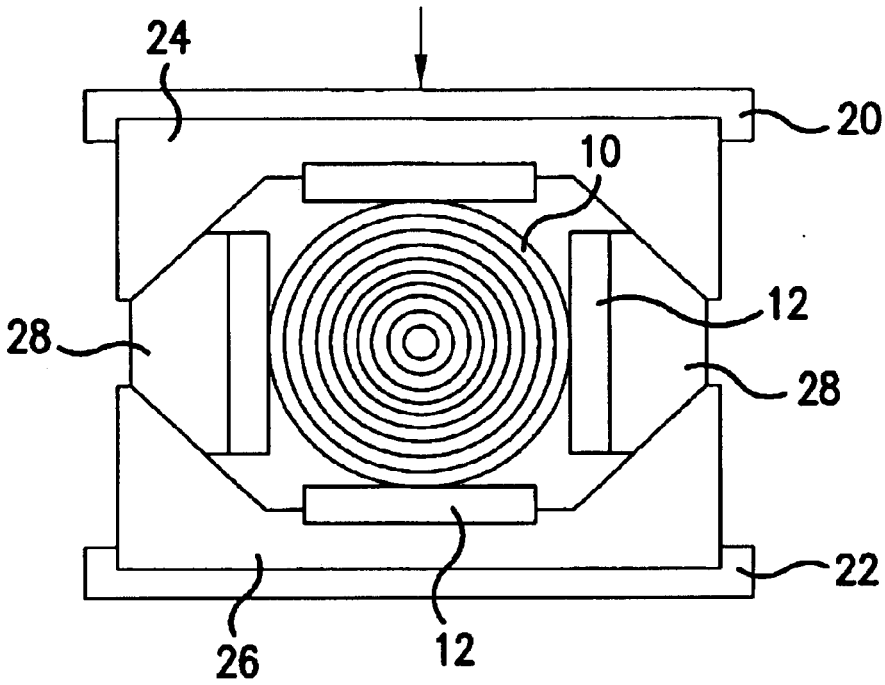
FIGS. 2A and 2B are schematic views a compressing die set used in the steps shown in FIGS. 1A–1C.
Figure 2B:
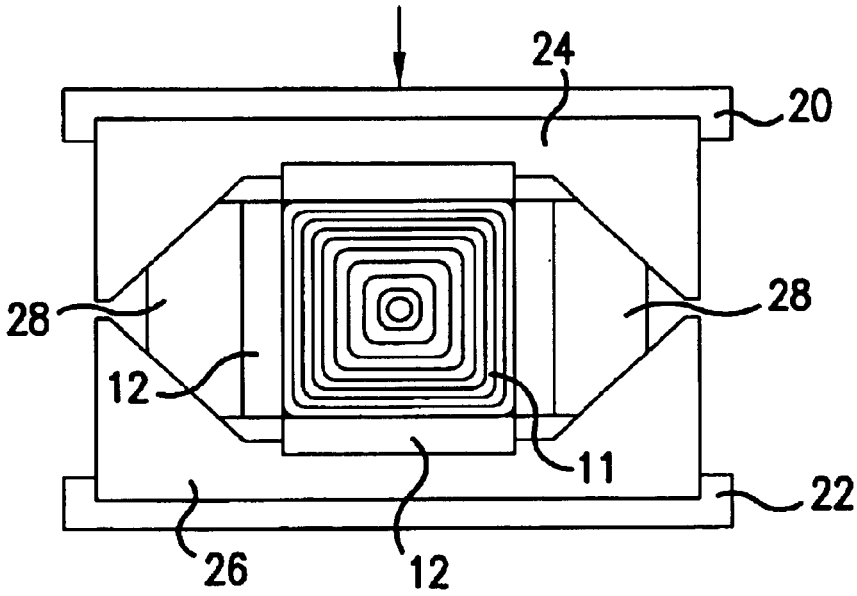

The movable plate 20 is moved upward to open the upper die 24, the lower die 26 and the side dies 28 and 28, then the log 10 and the metal plates 12, 12 . . . are inserted into a rectangular space enclosed by the upper die 24, the lower die 26 and the side dies 28 and 28 as shown in FIG. 2A. Next, the movable plate 20 is downwardly moved in the direction of an arrow so as to press the metal plates 12, 12 . . . by the upper die 24, the lower die 26 and the side dies 28 and 28 as shown in FIG. 2B, so that the log is compressed and formed into a prismatic wood 11.

Figure 1C:
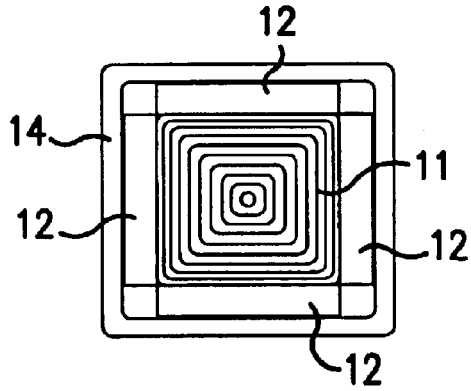

As shown in FIG. 1B, compressing the prismatic wood 11 by the metal plates 12, 12, . . . is released by upwardly moving the movable plate 20 to open the upper die 24, the lower die 26 and the side dies 28 and 28, so that the shape of the compressed wood 11 gradually reversed to the original log shape. To maintain the prismatic shape defined by the metal plates 12, 12, . . . after the dies are opened, the metal plates 12, 12, . . . are clamped by a band-shaped member 14, which is an example of restraint jigs, as shown in FIG. 1C. The band-shaped member 14 is formed like a frame and fixed to the metal plates 12, 12, . . . by proper means, e.g., screws. The band-shaped member 14 restrains the metal plates 12, 12, . . . at one place (a center) or two or more places of the prismatic wood 11.

In the case of using the band-shaped member 14 shown in FIG. 1C, preferably ends of the prismatic wood 11 and the metal plates 12, 12, . . . are projected from the compressing die set so as to easily fit the band-shaped member 14. The end of the log 10 projected from the compressing die set too can be compression-molded into the prismatic wood 11 by the metal plates 12, 12, . . . when the dies are closed.

Figure 3:
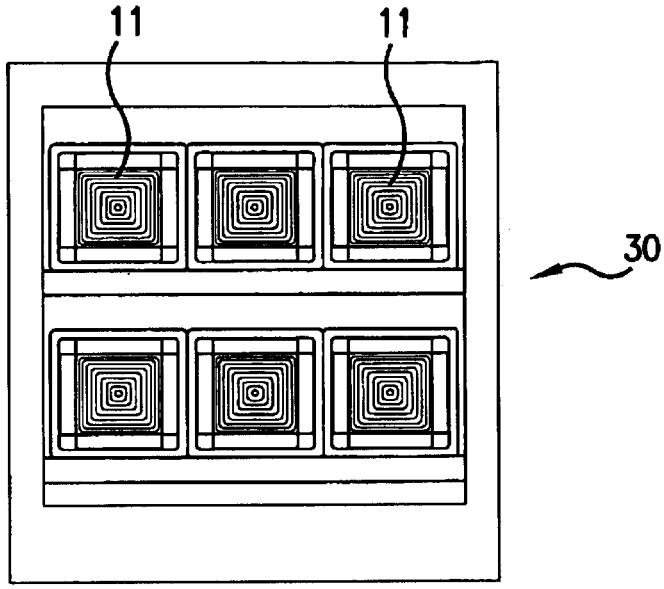
FIG. 3 is a schematic view showing a heat treatment of the prismatic wood formed by steps shown in FIG. 1.

As shown in FIG. 1C, the prismatic wood 11, whose flat faces are held in the state, in which they are compressed by the metal plates 12, 12 . . . by the band-shaped member 14, is taken out from the compressing die set, then a heat-treatment is applied to the prismatic wood in an electric furnace 30 as shown in FIG. 3. As shown in FIG. 3, a plurality of the prismatic wood 11, 11, . . . are set in the furnace 30 so as to efficiently treat. The heat-treatment may be a dry-heat treatment or a wet-heat treatment in which steam is used, preferably the dry-heat treatment is employed because no pressure container is required. Conditions of the heat-treatment depend on, for example, sort, size and water content of wood; in the case of raw larch having diameter of 160 mm, preferred temperature is 220° C. and preferred time is four hours.

Figure 4:
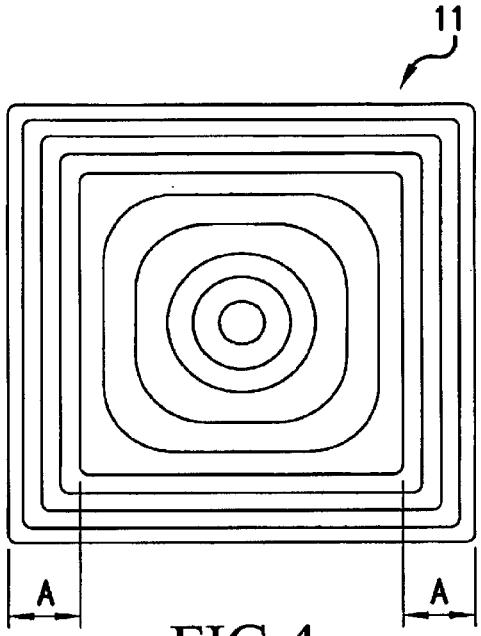
FIG. 4 is a transverse sectional view of the prismatic lumber manufactured by the method shown in FIGS. 1A–1C and 3.

The heat-treated wood 11 is shown in FIG. 4, an outer layer "A" of the prismatic wood 11 is mainly compressed, and a transverse sectional shape thereof is formed into a rectangular shape. For example, in the case of planing the flat outer faces of the prismatic wood 11 for making a pillar, planing should be executed within the compressed layer "A".

The log 10, which is a material of the prismatic wood 11, is raw wood, but a air-dried log 10 may be used. No free water exists in the air-dried log 10, but combined water exists in cell membrane. In the case of the prismatic wood 11 which is formed by compressing the air-dried log 10, the outer layer "A" (see FIG. 4) of the prismatic wood 11 is air-tightly compressed. Therefore, if cut ends of the prismatic wood 11 are closed in the state in which the outer flat faces of the prismatic wood 11 are compressed by the metal plates 12, 12, . . . , the outer layer "A" can be substantially air-tightly closed.

By applying the heat-treatment to the air-tightly compressed prismatic wood 11, a wet-heating atmosphere, in which the compressed state can be permanently fixed, can be made in the outer layer "A", whose volume has been reduced by the compression, by the water combined with cell membrane.

In the case of using a raw log 10 too, the air-dried prismatic wood 11 can be made by the steps of: closing cut ends of the compressed prismatic wood 11; applying the wet-heat treatment to permanently fix the shape of the prismatic wood 11; opening the cut ends while the heat treatment; and continuing the heat treatment.

In the case of applying the heat treatment without closing the cut ends of the prismatic wood 11, if the temperature of the heat treatment is 180–220° C. and the time thereof is longer than that of the heat treatment in which the cut ends are closed, the shape of the prismatic wood 11 can be permanently fixed and the prismatic wood 11 whose water content is almost equal to that of air-dried wood can be made.

By compressing the air-dried log 10 and applying the heat treatment under the dry-heating atmosphere, the prismatic wood 11 can be used as lumber without further dry.

Figure 5A:
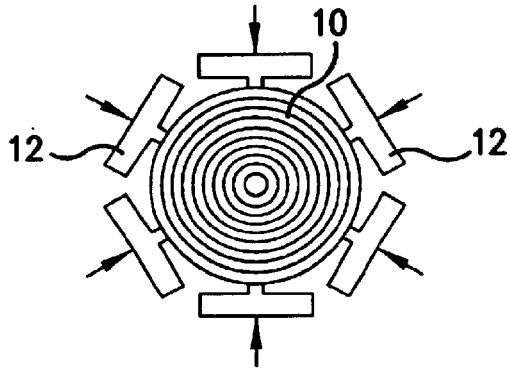
FIGS. 5A and 5B are explanation views of another example of compressing wood.
Figure 5B:
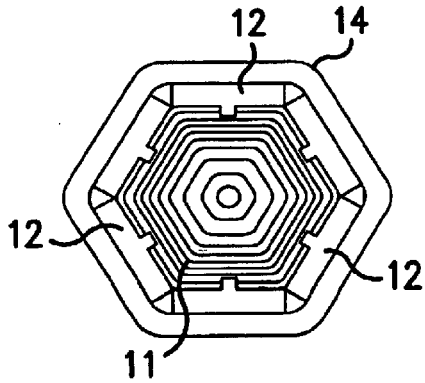

In the embodiment shown in FIGS. 1A–1C, 2A and 2B, the transverse sectional shape of the prismatic wood 11 is rectangular; the prismatic wood having a hexagonal sectional shape can be made by the steps of: arranging the six metal plates 12, whose length is equal to that of the log 10, to enclose and contact the log as shown in FIG. 5A; and applying external force to the metal plates 12, 12, . . . in the directions of arrows (directions perpendicular to the metal plates 12) shown in FIG. 5B so as to compress the outer circumferential face of the log 10 and form it into a prismatic shape.

The compression may be executed in the two-axis compressing die set. In the two-axis compressing die set, a hexagonal space enclosed by the upper die, the lower die and the pair of side dies is formed when the dies are opened.

Further, the metal plates 12, 12, . . . are restrained by the band-shaped member 14, which acts as the restraint jig, as shown in FIG. 5B. The band-shaped member 14 is made of a metal, formed like a hexagonal frame and fixed to the metal plates 12, 12, . . . by screws or the like. The band-shaped member 14 restrains the metal plates 12, 12, . . . at one place (a center) or two or more places of the prismatic wood 11.

In the case of using the band-shaped member 14 shown in FIG. 5B, preferably ends of the prismatic wood 11 and the metal plates 12, 12, . . . are projected from the compressing die set so as to easily fit the band-shaped member 14. The end of the log 10 projected from the compressing die set too can be compression-molded into the prismatic wood 11 by the metal plates 12, 12, . . . when the dies are closed.

Figure 6:
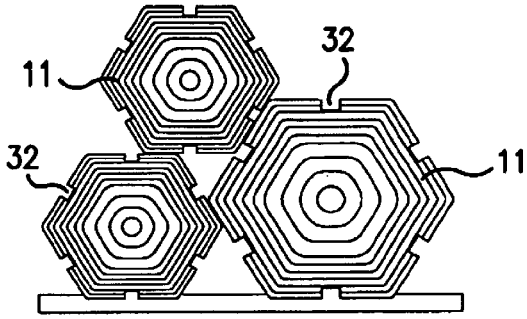
FIG. 6 is a transverse sectional view of the prismatic lumber manufactured by the method shown in FIGS. 5A and 5B.

As shown in FIGS. 5A and 5B, projected lines are formed in pressing faces, which are capable of pressing the log 10, of the metal plates 12, 12, . . . , so the heat-treated prismatic wood 11 has the hexagonal section as shown in FIG. 6, and there are formed grooves 32 in the flat outer faces of the prismatic wood 11 and extended in the longitudinal direction thereof as shown in FIG. 6.

Figure 7A:
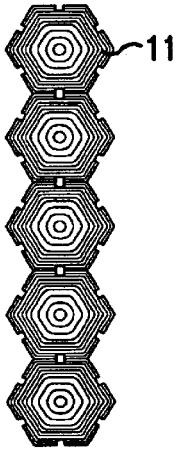
FIGS. 7A–7C are plan views of an example of connecting the prismatic lumber.
Figure 7B:
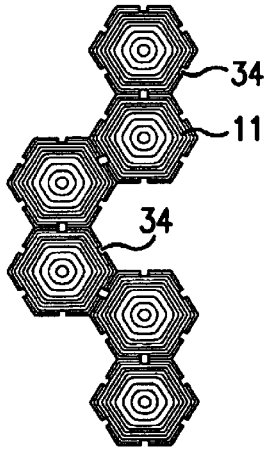
Figure 7C:
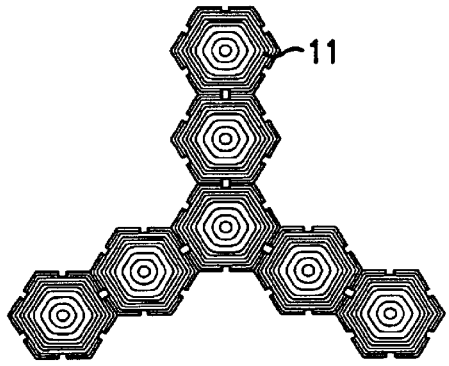

Since the transverse sectional shape of the prismatic wood 11 is hexagonal as shown in FIG. 6, as shown in FIGS. 7A–C, a plurality of the prismatic wood may be linearly arranged (see FIG. 7A), arranged zigzag (see FIG. 7B) and branched (see FIG. 7C), namely many types structures can be realized.

Adjacent wood 11 can be mutually securely connected by inserting a connecting member into a connecting hole 34, which is formed by the groove 32.

Figure 8A:
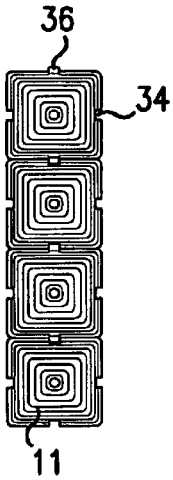
FIGS. 8A–8C are plan views of another example of connecting the prismatic lumber.
Figure 8B:
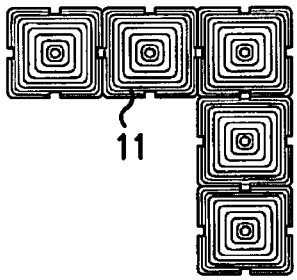
Figure 8C:
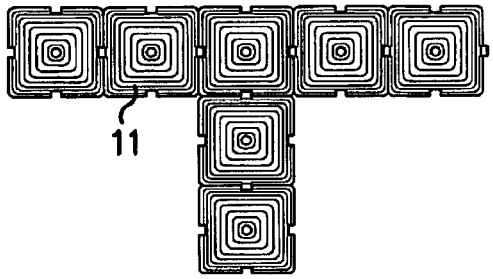

In FIGS. 5A and 5B, the projected line is formed in the pressing face, which presses the log 10, of the metal plate 12; in FIGS. 8A–C, each log was compressed by the metal plates 12 having the projected lines in the pressing faces and the metal plates 12 having grooves in the pressing faces, so that the groove 32 or the projected line 36 is formed each outer flat face of the prismatic wood 11 and extended in the longitudinal direction thereof. With this structure, the groove 32 and the projected line 36 of the adjacent wood 11 are engaged so as to mutually securely connect the adjacent wood 11.

As shown in FIGS. 8A–8C, the prismatic wood 11 has the rectangular section, so a plurality of wood may be linearly arranged (see FIG. 8A), arranged at the right angle (see FIG. 8B) and branched (see FIG. 8C), namely many types of structures can be realized.

As shown in FIG. 5A, the projected lines are formed in the pressing faces of the metal plates 12, so the grooves 32 can be formed in the outer flat faces of the heat-treated prismatic wood 11, which has the hexagonal section, and extended in the longitudinal direction thereof. By forming patterns in the pressing faces of the metal plates 12 by projections and recesses, the patterns of the metal plates 12 can be transferred to the outer flat faces of the heat-treated prismatic wood 11. The transferred patterns are capable of existing in the flat faces of the prismatic wood 11 even if the outer flat faces are planed, so the wood can be used as a prismatic pillar exposed in a room.

Of course, adjacent wood 11 may be connected or integrated by engaging projected pattern of one wood 11 with a recessed pattern of the other wood 11.

In FIGS. 1A–5B, the prismatic wood 11 is compressed by the metal plates 12, 12, . . . to form the outer flat faces, and it is heat-treated in the state, in which the outer flat faces are compressed, so as to permanently fix the compressed shape; if the heat-treatment time is shorter than that for permanently fixing the compressed shape, expandable wood is realized. The expandable wood is capable of reversing a shape by absorbing water, and a great counter force can be gained by restraining the shape-reversion. A connected structure shown in FIGS. 9A and 9B can be realized by the expandable wood and the prismatic wood whose shape has being permanently fixed.

To form the connected structure, firstly the prismatic wood 11, 11, . . . , whose shape has being permanently fixed, are arranged in a metal frame 38, then the expandable wood 11' is inserted into a space 42 among the prismatic wood 11, 11, . . . Next, water is applied to the prismatic wood 11, 11, . . . and the expandable wood 11', so that the expandable wood 11' tries to reverse the shape and generates the great counter force as shown in FIG. 9B. Results of measuring the counter force is shown in FIG. 10.

Figure 10:
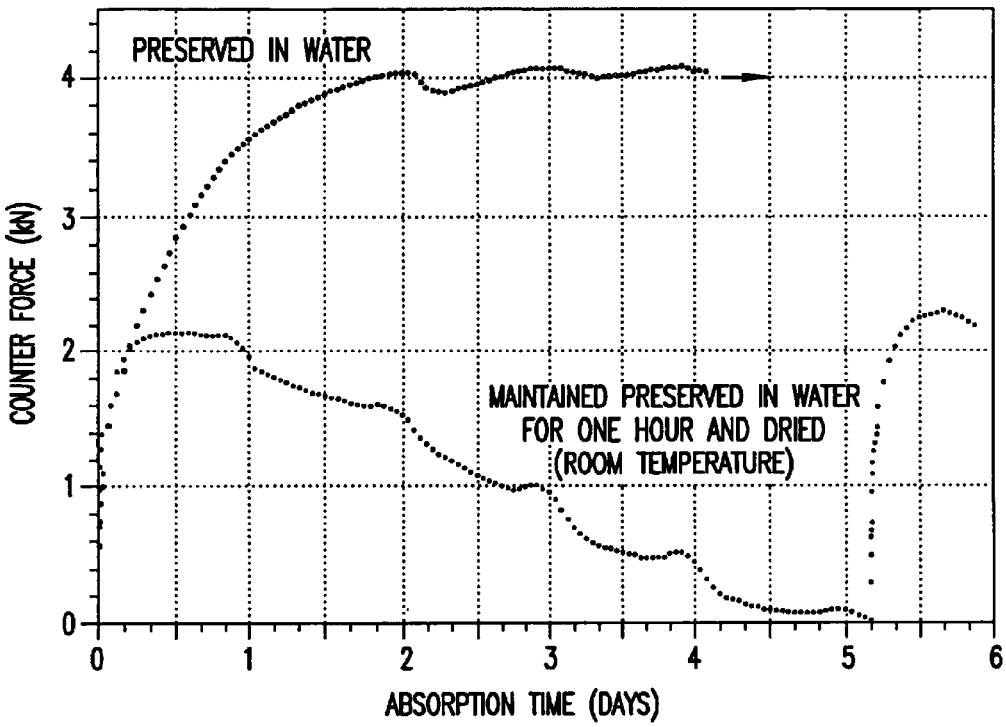
FIG. 10 is a graph of counter force of shape-reversion of the connected prismatic lumber shown in FIGS. 9A and 9B.

In the experiment relating to FIG. 10, the rectangular expandable wood 11', whose width is 100 mm and length is 40 mm, was made by compressing and heat-treating a larch log 10 having diameter of 150 mm, and variation of the counter force was measured.

As shown in FIG. 10, in the case of the expandable wood 11' preserved in water, it took two days, from starting water absorption, to reach the counter force about 4 kN, then the value was maintained.

On the other hand, in the case of the expandable wood 11' preserved in water for one hour and naturally dried at room temperature, it took 0.5 day, from starting water absorption, to reach the counter force maximum value, then the value gradually reduced and reached almost zero on the fifth day as shown in FIG. 10. Even if the counter force reached zero, the counter force of the expandable wood 11' can be regained by soaking it in water for about one hour.

Therefore, the expandable wood 11', which is made by compressing and heat-treating the log 10, can be effectively used as lumber for structures in wet environments, e.g., a water path, a wall of tunnel, a floor of a bath room.

In the above described embodiments, the compressing die set for compression-molding the prismatic wood 11 is the two-axis die set shown in FIGS. 2A and 2B, but the two-axis die set has many movable parts and a complex structure. Thus, an example of one-axis compressing die set, whose structure is simpler than that of the two-axis compressing die set, is shown in FIGS. 11A and 11B.

Figure 11A:
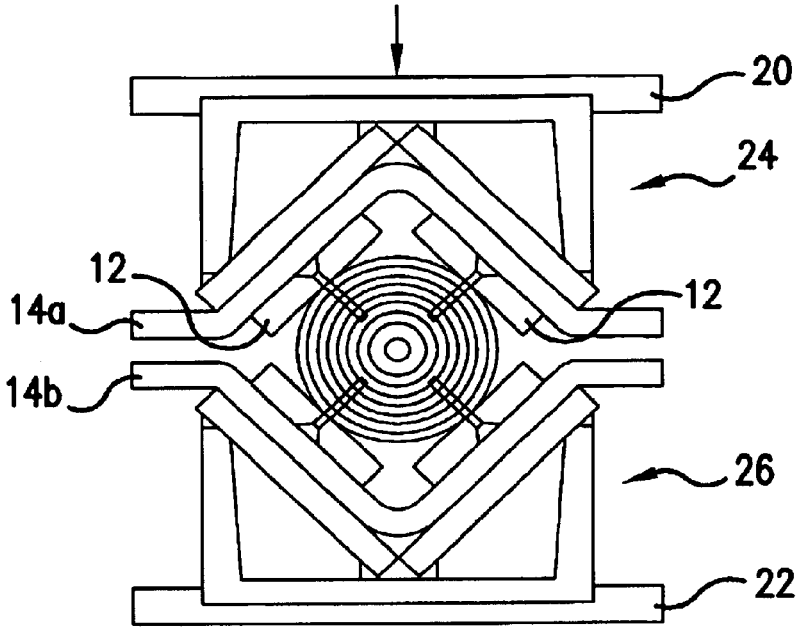
FIGS. 11A–14B are schematic views of another compressing die set.
Figure 11B:
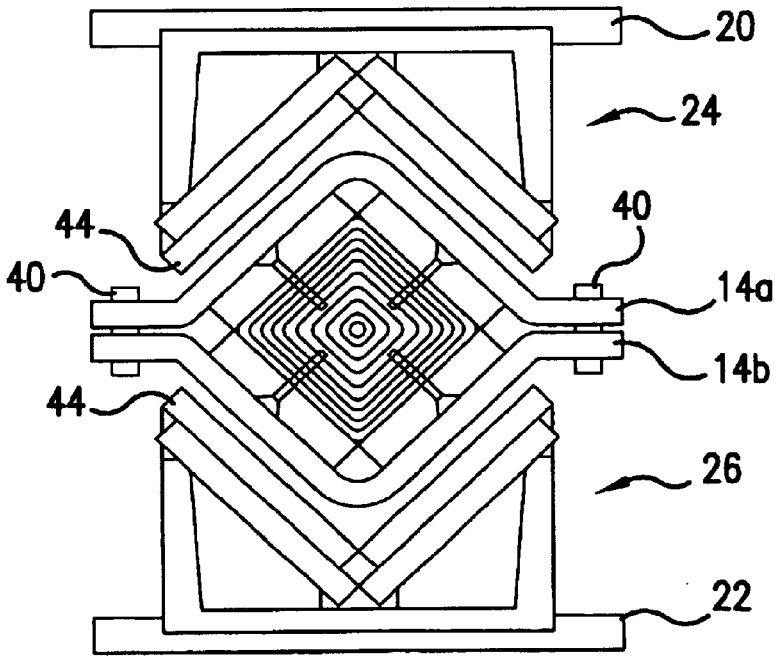

The compressing die set shown in FIGS. 11A and 11B includes an upper die 24 fixed to a movable plate 20 capable of moving in the vertical direction and a lower die 26 fixed to a fixed plate 22. The compressing die set shown in FIGS. 11A and 11B is made by welding metal plates having prescribed thickness.

When the upper die 24 and the lower die 26 are closed, cavity faces of the upper die 24 and the lower die 26 form a cavity whose transverse sectional shape corresponds to that of the prismatic wood 11, and grooves 44 and 44 for accommodating band-shaped members **14*a* and 14*b*, which act as the restraint jigs restraining the metal plates 12, 12, . . . compressing the log 10 and holding the flat faces of the prismatic wood 11, are formed in the cavity faces. The band-shaped members 14*a* and 14*b* respectively have extended sections, and the extended sections are overlapped as shown in FIG. 11B and connected by bolts 40 and 40**, so that they form a frame-like body.

Note that, the cavity faces of the upper die 24 and the lower die 26 shown in FIGS. 11A and 11B are formed into V-shape, so the band-shaped members **14*a* and 14*b*** are also formed into V-shape.

In the case of compressing the log 10 by the compressing die set shown in FIG. 11, the metal plates 12, 12, . . . are fixed at prescribed positions of the log 10 by nails or the like, then they are mounted onto the cavity face of the lower die 26, in which the band-shaped member **14*b* has been provided in the groove 44**.

Next, the band-shaped member **14*b* is mounted onto the log 10, which has been mounted on the cavity face of the lower die 26 and to which the metal plates 12, 12, . . . have been fixed, the extended sections of the band-shaped member 14*b* are piled onto the extended sections of the band-shaped member 14*b*, and the movable plate 20 is downwardly moved in a direction of an arrow so as to close the dies 24 and 26, so that the prismatic wood 11** having the rectangular sectional shape can be formed.

As shown in FIG. 11B, the extended sections of the band-shaped members **14*a* and 14*b* are mutually overlapped and securely connected by the bolts 40 and 40, so that the frame-like body for restraining the metal plates 12, 12, . . . , which are capable of compressing the log 10**, can be formed.

By moving the movable plate 20 upward, the compressed prismatic wood 11, whose compressed state is maintained by the metal plates 12, 12, . . . , can be taken out from the compressing die set. The compressed prismatic wood 11 taken out is heat-treated in the compressed state.

Figure 12A:
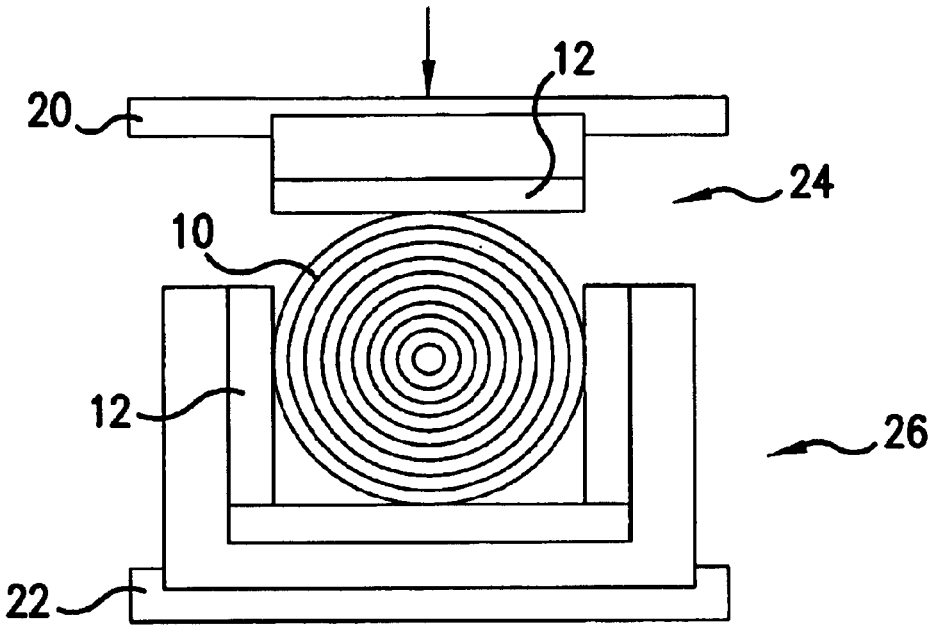
Figure 12B:
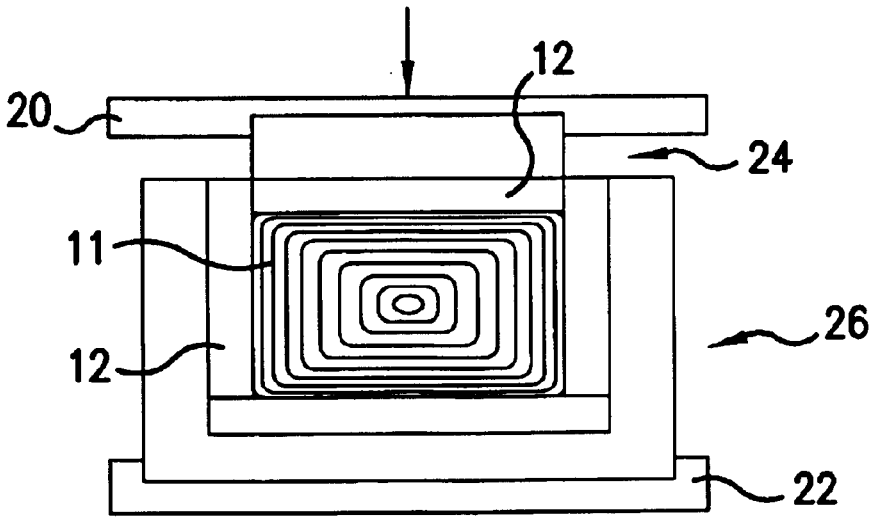

In the compressing die set shown in FIGS. 11A and 11B, the cavity faces of the dies 24 and 26 are formed into the V-shape; in FIGS. 12A and 12B, the upper die 24 fixed to the movable plate 20 is formed into a plate-shape, and a transverse sectional shape of the lower die 26 fixed to the fixed plate 22 is formed into U-shape, so that the metal plates 12, 12, . . . can be easily arranged along an inner face of the lower die 26, as shown in FIG. 12A, without previously fixing the metal plates 12, 12, . . . to the log 10 by nails or the like. The log 10 is inserted into the lower die 26, in which the metal plates 12, 12, . . . have been arranged along the U-shaped inner face.

Successively, the upper die 24 is moved downward together with the movable plate 20, so that the log 10 can be compressed and the rectangular wood 11 can be produced.

Figure 13A:
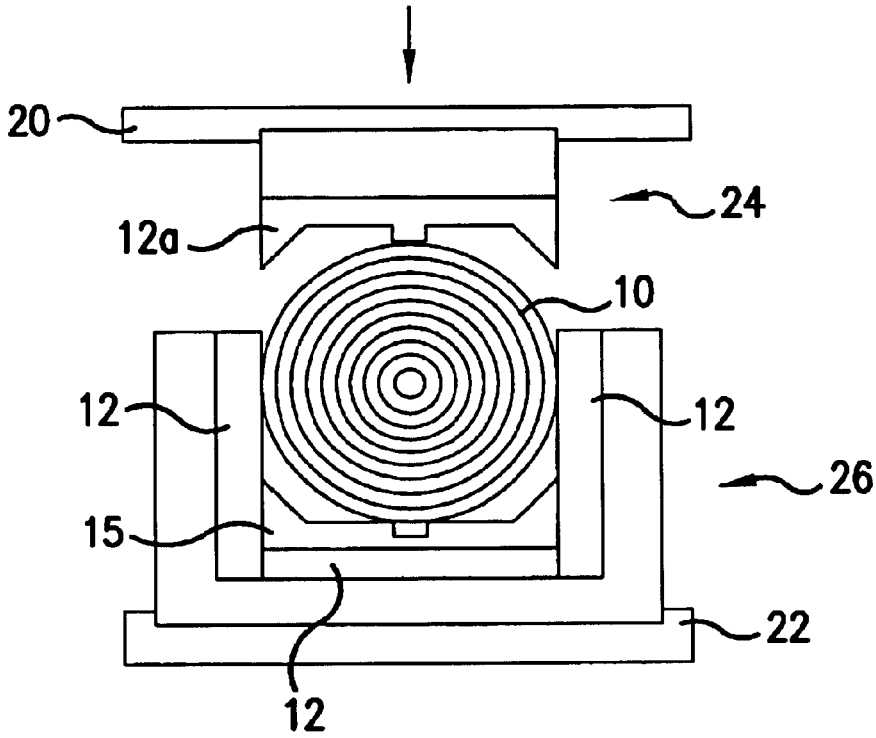
Figure 13B:
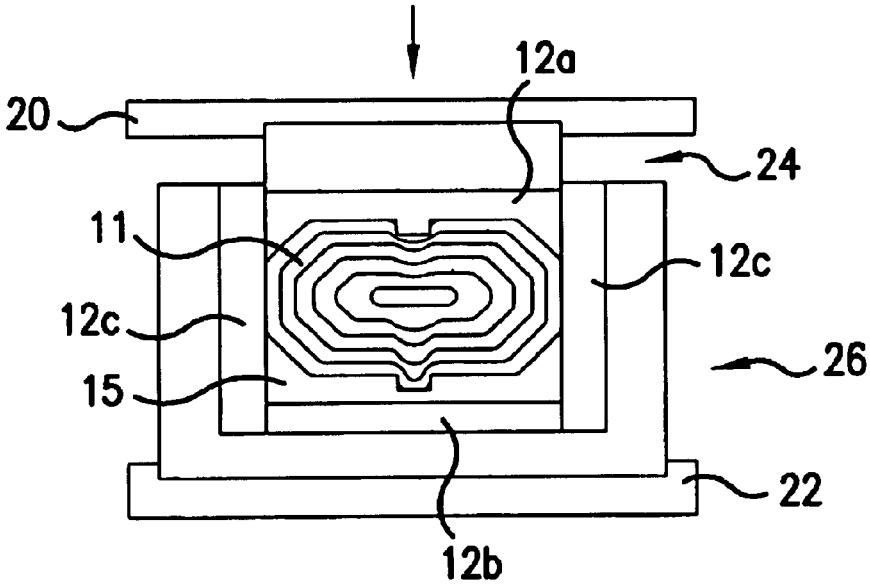

In FIG. 13A, the metal plate 12, which is pressed by the upper die 24 shown in FIGS. 11A and 12B, is a metal plate **12*a* having a central projected line, and a plate 15 having a central groove is provided in the lower die 26; as shown in FIG. 13B, the prismatic wood 11 having a projected line and a groove in the outer flat faces can be made by moving the upper die 24** downward.

The prismatic wood 11 shown in FIG. 13B has a octagonal transverse sectional shape, one of outer flat faces has the groove, and another outer flat face has the projected line. As shown in FIG. 8, the projected line and the groove are used for connecting the adjacent prismatic wood 11.

In the case that diameter of the log 10 is longer than width of an opening section of the lower die 26 shown in FIGS. 12A–13B, the log 10 cannot be inserted into the lower die 26, in which the metal plates 12, 12, . . . have been arranged along the inner face thereof. In this case, guide members 46 and 46 may be provided to the opening section of the lower die 26 as shown in FIGS. 14A and 14B.

Figure 14A:
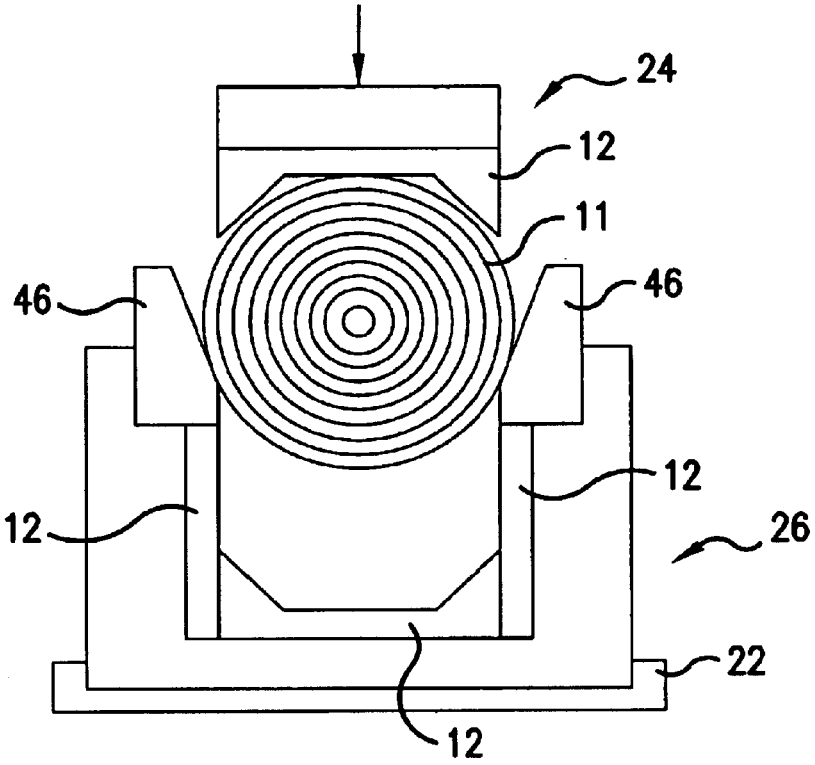

In FIG. 14A, even if the case that the log 10 cannot be inserted into the lower die 26, the log 10 is moved downward along slope faces of the guide members 46 and 46 by moving the upper die 24, which is fixed to the movable plate (not shown), toward the lower die 26, further it is compressed and deformed by the slope faces of the guide members 46 and 46, so that it can be inserted into the lower die 26.

Figure 14B:
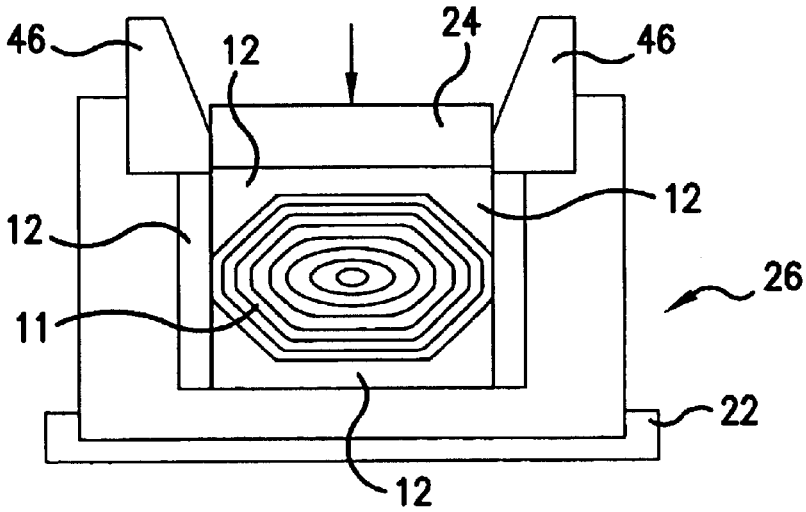

The deformed log in the lower die 26 is compression-molded into the prismatic wood 11 by the upper die 24 as shown in FIG. 14B.

Note that, in the compressing die set shown in FIGS. 14A and 14B, the pressing faces of the metal plates 12, 12, . . . are designed to form the cavity, which are formed by the metal plates 12, 12, . . . and which has the octagonal sectional shape so as to form the octagonal prismatic wood 11, when the dies 24 and 26 are closed.

When the log 10 is compressed by the compressing die set shown in FIGS. 1A–14B, compressing load suddenly rises in a final stage of the compression. The rise of the compressing load is caused by flash of corners of the prismatic wood 11, which is formed in gaps between the metal plates 12, 12, . . . In this case, wasteful compressing load is applied to compress the flash, so required load can be reduced by avoiding the compression of the flash.

Figure 15A:
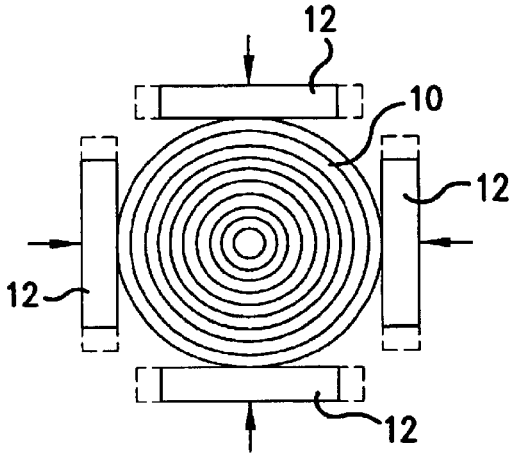
FIGS. 15A and 15B are explanation views showing an improved method of the method shown in FIGS. 1A–1C.
Figure 15B:
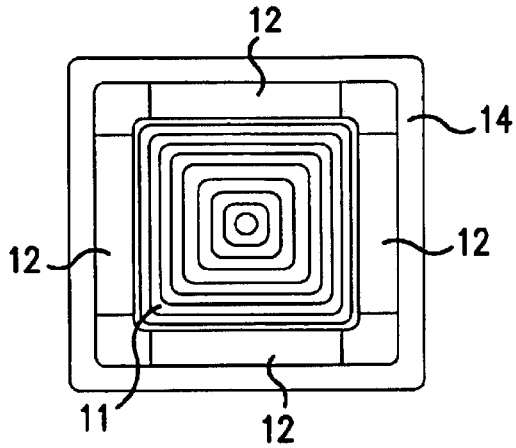

To avoid the compression of the flash, width of the metal plates 12, 12, . . . for pressing the log 10 are made narrow as shown in FIG. 15A so as to escape the flash formed at the corners of the compressed wood 11 via the gaps between the metal plates 12 and 12 as shown in FIG. 15B, so that the required compressing load can be reduced (for example, the required load can be reduced from 25 t to 13 t).

The flash formed at the corners of the prismatic wood 11 can be cut and removed after the heat treatment. Especially, in the case of compression-molding the log 10 with bark into the prismatic wood 11, the bark is peeled off from the prismatic wood 11 after the heat treatment, so the flash can be removed with no problems.

In the prismatic wood 11 made by the method shown in FIGS. 1A–15B, sheared cracks or cracks at corners of growth rings are sometimes caused. The cracks are formed during the compression and the heat treatment.

Figure 16:
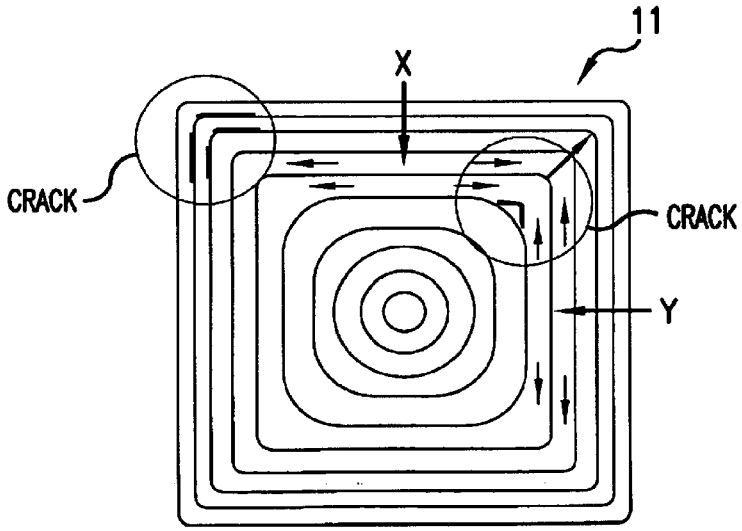
FIG. 16 is an explanation view showing cracks forming in the compression step.

The reason of forming the cracks at corners of growth rings will be explained. When the log 10 is compression-molded, growth rings are compressed in the radial direction. Outer growth rings of the log 10 are deformed and made flat by the compression; inner growth rings are little deformed. Further, as shown in FIG. 16, the corners of the deformed growth rings of the prismatic wood 11 are thrust outward when the compressing load is applied to the outer flat faces of the prismatic wood 11 at the right angle (in the directions of arrows X and Y), so that the cracks are apt to be formed at the corners of the growth rings.

The thrust deformation of the growth rings are made greater neat the outer face of the wood, so that the cracks are apt to be formed.

As described above, the cracks at the corners of growth rings of the prismatic wood 11 are caused by sudden deformation of the growth rings of the prismatic wood 11. To effectively prevent the prismatic wood 11 from forming the cracks, the sudden deformation of the growth rings should be restricted.

Figure 17A:
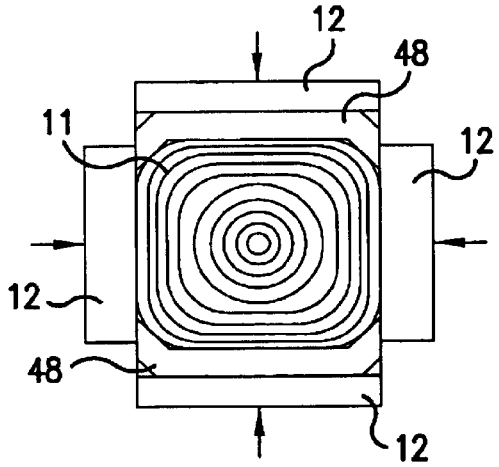
FIGS. 17A and 17B are explanation views showing a compression method for preventing cracks.
Figure 17B:
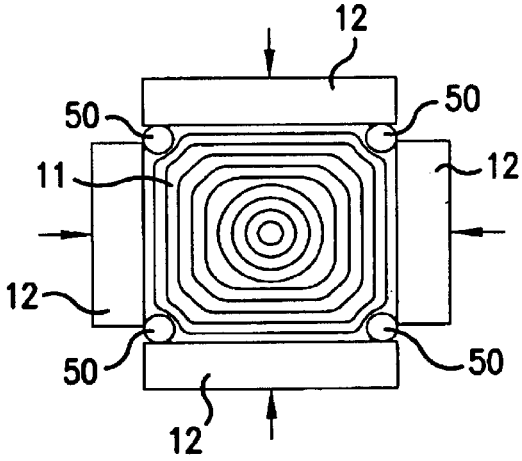

A compressing die set capable of restricting the sudden deformation of growth rings is shown in FIGS. 17A and 17B. In the die set shown in FIG. 17A, claw plates 48 and 48, in each of which both ends are bent inward like claws so as to compress the corners of the prismatic wood 11 and which are respectively welded to inner faces of the metal plates 12, 12, . . . for compressing the log 10. In the die set shown in FIG. 17B, columnar rods 50, which are capable of compressing the corners of the prismatic wood 11 while the compression-molding, are respectively welded to ends of the metal plates 12 and 12.

Figure 18A:
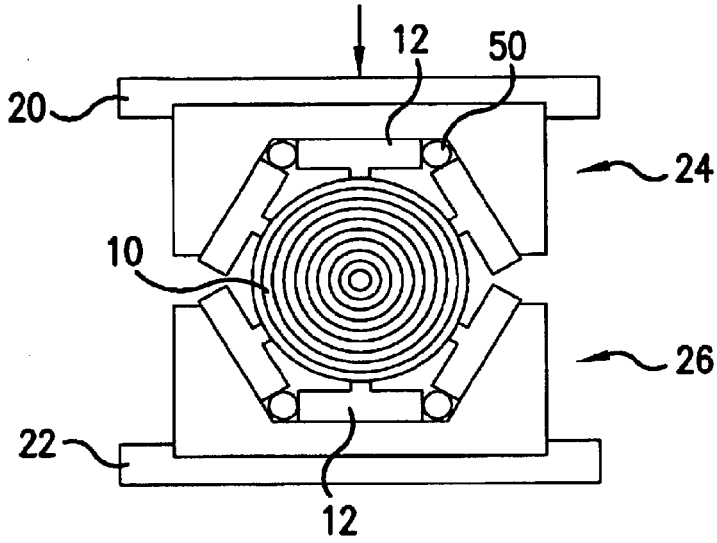
FIGS. 18A and 18B are explanation views showing another compression method
Figure 18B:
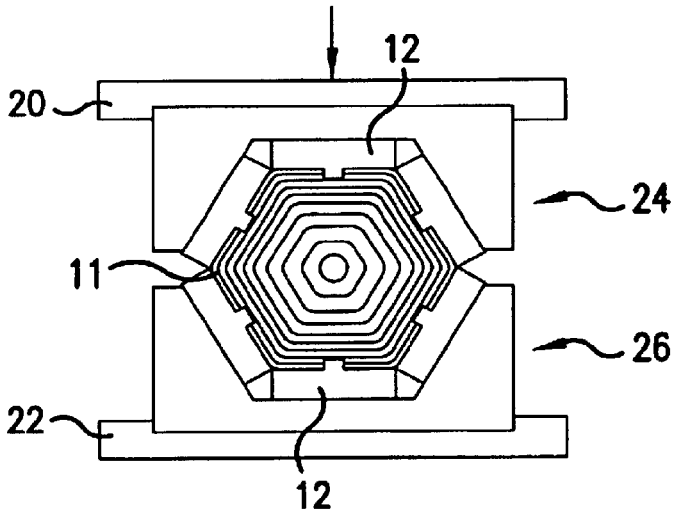

In the case of molding the prismatic wood 11, shown in FIG. 6, having the hexagonal section and the grooves 32 in the outer flat faces, the prismatic wood 11 having little cracks can be molded by compressing die sets shown in FIGS. 18A and 18B.

In the die set shown in FIG. 18A, the six metal plates 12, 12, . . . having projected lines in the pressing faces are provided on the cavity faces of the upper die 24 and the lower die 26 when the dies are opened. Further, the circular rods 50, 50, . . . are respectively inserted into gaps between the metal plates 12, then the compression is started.

By inserting the rods 50, 50, . . . into the gaps between the metal plates 12, the corners of the wood, each of which are formed by the adjacent metal plates 12, can be uniformly compressed.

If the compression is executed without inserting the rods 50, 50, . . . in the gaps between the metal plates 12, woody part of the wood is excessively moved to some corners, so the cracks are apt to be formed at other corners.

In the final stage of the compression, the rods 50, 50, . . . are pulled out, and the compression is further continued, so that the cracks caused by uneven movement of the woody part can be prevented and the hexagonal wood 11 having the grooves can be produced.

In the above described methods of producing the prismatic wood, a center of the log 10 is not compressed and it takes a long time to wholly air-dry the log 10.

Figure 19A:
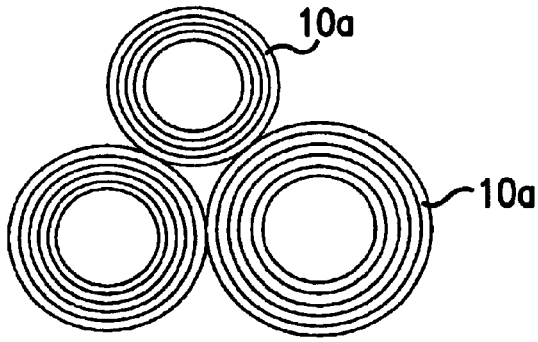
FIGS. 19A–19C are explanation views showing a method of compressing a hollow log.

To fully air-dry the log, a hollow log 10*a* shown in FIG. 19A is used as the log; the hollow log 10 is dried from an outer circumferential face and an inner circumferential face.

Figure 19B:
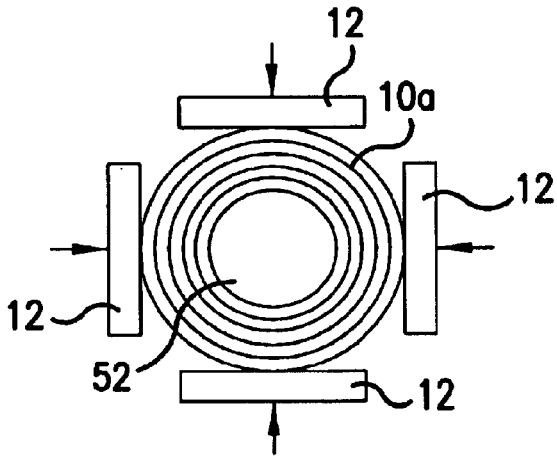

To compression-mold the hollow log 10*a*, a steel mandrel 52 is inserted in a hollow space of the log 10*a* as shown in FIG. 19B, and the log is compression-molded by the metal plates 12, 12, . . . With this method, the prismatic hollow wood 11*a*, which are fully compressed between the mandrel 52 and the metal plates 12, 12, . . . as shown in FIG. 19C, can be produced.

Figure 19C:
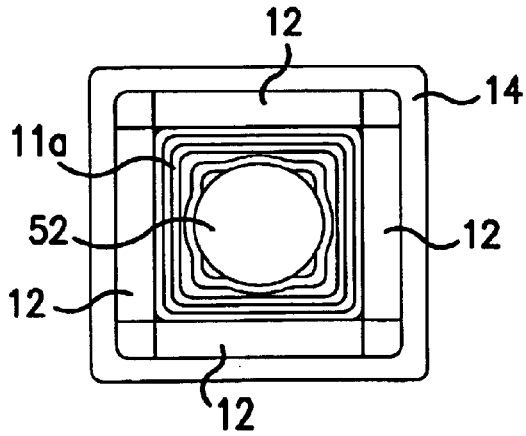

As shown in FIG. 19C, the metal plates 12, 12, . . . compress to make the outer flat faces of the hollow prismatic wood 11*a*, and the band-shaped member 14, which acts as the restraint jig, restrains the metal plates 12, 12, . . . so as to hold the outer flat faces of the wood 11*a* in the state in which the mandrel 52 is inserted in the hollow space.

Further, the prismatic wood 11*a* in the state shown in FIG. 19C is heat-treated in the electric furnace 30 as shown in FIG. 3 so as to permanently fix the compressed shape.

Note that, the heat-treatment may be the wet-heat treatment using steam.

Figure 20A:
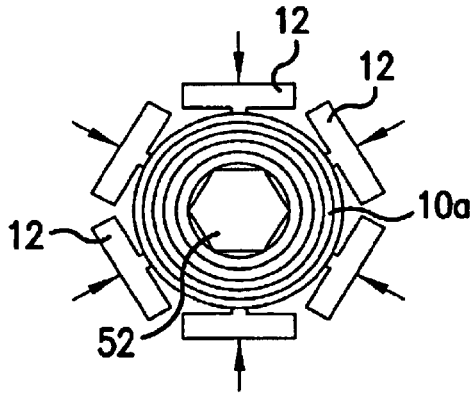
FIGS. 20A and 20B are explanation views showing another method of compressing a hollow log.
Figure 20B:
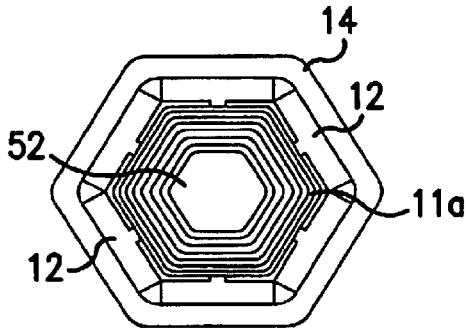

The hollow prismatic wood having the hexagonal transverse sectional shape can be produced by compressing the hollow log 10 shown in FIG. 19A as shown in FIGS. 20A and 20B.

As shown in FIG. 20A, the hollow wood can be produced by the steps of: arranging the six metal plates 12, 12, . . . , whose length is equal to that of the hollow log 10*a* in which the mandrel 52 has been inserted in the hollow space, to enclose and contact the hollow log 10*a*; and applying external force to the metal plates 12, 12 . . . in the directions of arrows (directions perpendicular to the metal plates 12, 12 . . .) shown in FIG. 20A so as to compress the outer circumferential face of the hollow log 10*a* and form the hollow prismatic wood 11*a* having the hexagonal sectional shape and the grooves in the outer flat faces.

Further, as shown in FIG. 20B, the metal plates 12, 12, . . . are restrained by the band-shaped member 14, which acts as the restraint jig, and the hollow prismatic wood 11*a*, in which the mandrel 52 is inserted in the hollow space, is heat-treated so as to permanently fix the compressed shape.

Figure 21:
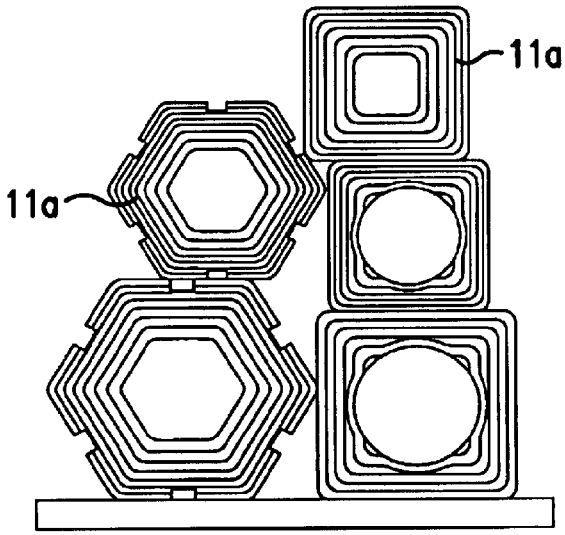
FIG. 21 is a transverse sectional view of the prismatic lumber manufactured by compressing the hollow log.

After the compression shown in FIGS. 19A–20B, the mandrels 52 are removed from the hollow prismatic wood 11*a*, 11*a*, . . . , each of which has been heat-treated in the state in which the metal plates are restrained by the band-shaped member 14, so that the hollow prismatic lumber 11*a*, 11*a*, . . . shown in FIG. 21 can be produced.

The hollow prismatic lumber 11*a*, 11*a*, . . . can be connected as shown in FIGS. 7A–8C.

Trees damaged by high wind, heavy snow, etc. have damaged parts, e.g., cracks, so they are usually disused. Therefore, it is effective to use damaged wood, which have been damaged by high wind, heavy snow, etc., as lumber.

The damaged wood having cracks, etc. 10*b*, 10*b*, . . . (the damaged logs 10*b*) shown in FIG. 22A will be compressed and formed into prismatic lumber.

Figure 22A:
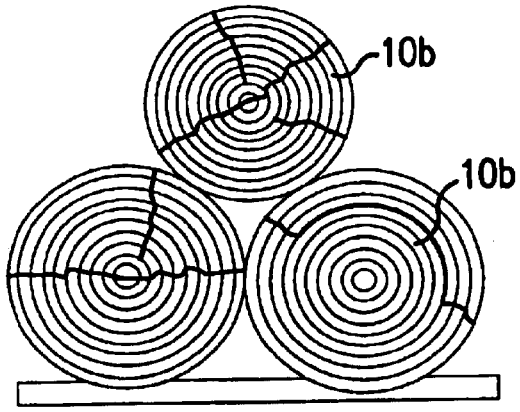
FIGS. 22A–22C are explanation views showing a method of compressing wood which is damaged by high wind.
Figure 22B:
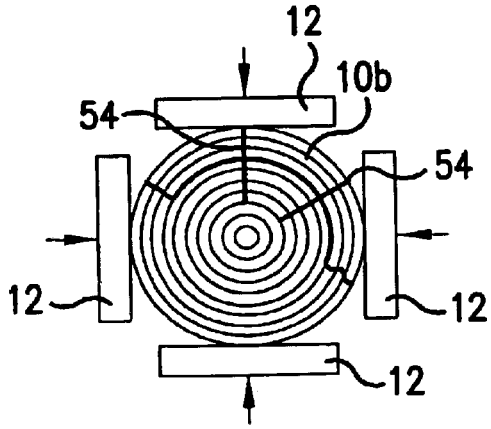

As shown in FIG. 22A, a cracked part of the damaged log 10B is temporally fixed by bamboo nails 54, 54, . . . or the like, and the six metal plates 12, 12, . . . , whose length is equal to that of the log 10 to enclose and contact the damaged log 10*b* at four sides. External force is applied to the metal plates 12 in the directions of arrows (directions perpendicular to the metal plates 12) shown in FIG. 22B so as to compress the outer circumferential face of the damaged log 10*b* and form the rectangular prismatic wood 11*a*.

Figure 22C:
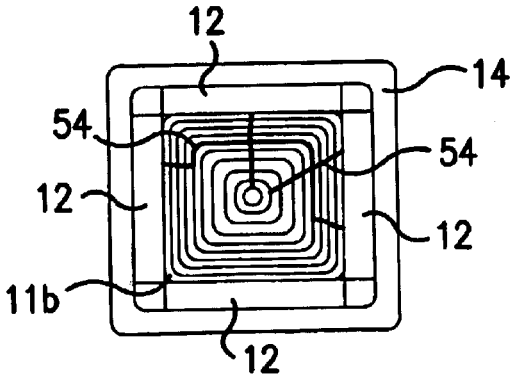

Further, as shown in FIG. 22C, the metal plates 12, 12, . . . are restrained by the band-shaped member 14, which acts as the restraint jig, and the prismatic wood 11*b* is heat-treated so as to permanently fix the compressed shape.

Figure 9A:
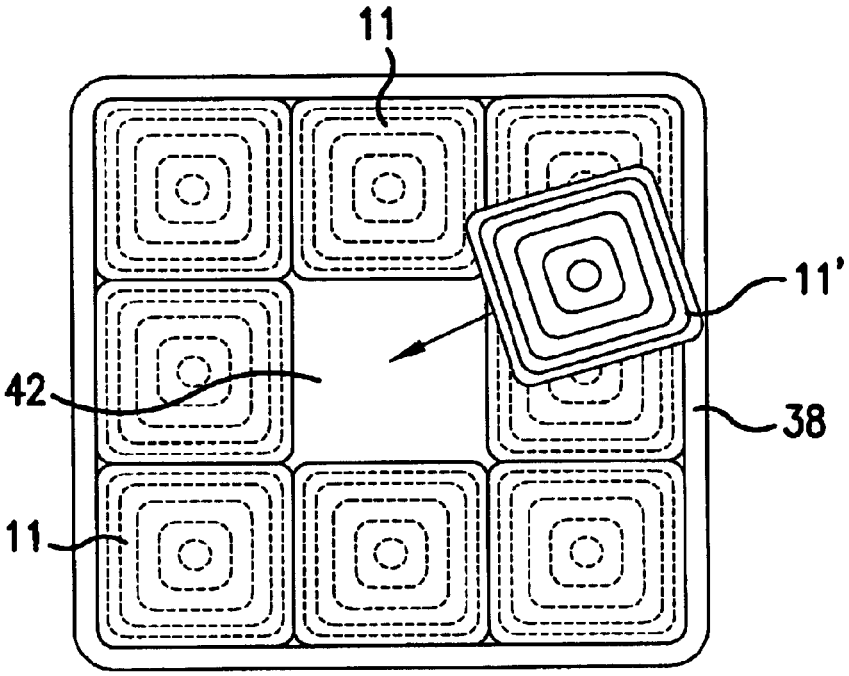
FIGS. 9A and 9B are plan views of other example of connecting the prismatic lumber.
Figure 9B:
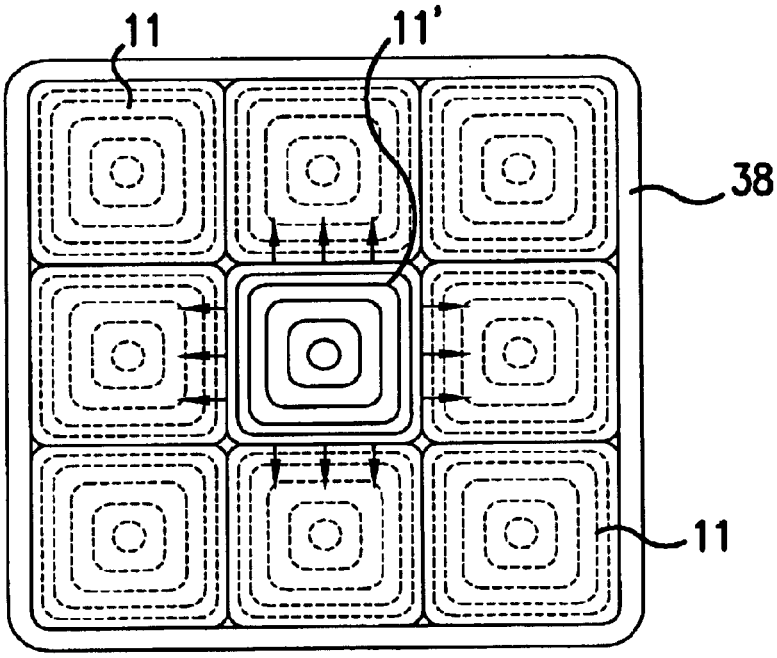
Figure 23:
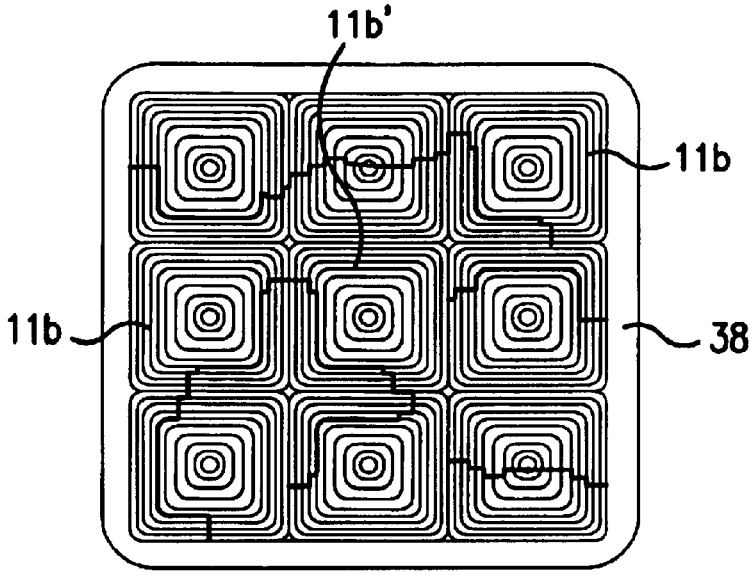
FIG. 23 is a front view of an example of connecting the prismatic lumber which is manufactured by compressing the damaged wood.

In the case of using the expandable lumber 11*b*' which was heat-treated in a short time, the expandable lumber 11' is combined with the prismatic lumber 11*b*, 11*b*, . . . permanently fixed; as shown in FIG. 23, the prismatic lumber 11*b*, 11*b*, . . . are arranged in a metal frame 38 and the expandable lumber 11*b*' is inserted in a space between the prismatic lumber 11*b*, 11*b*, . . . as well as the example shown in FIGS. 9A and 9B. Next, water is applied to the prismatic lumber 11*b*, 11*b*, . . . and the expandable lumber 11*b*', so that the expandable lumber 11' tries to reverse the shape and generates the great counter force. The cracks of the prismatic lumber 11*b*' form ornamental patterns, so the combination can be used as a paving material.

Figure 24A:
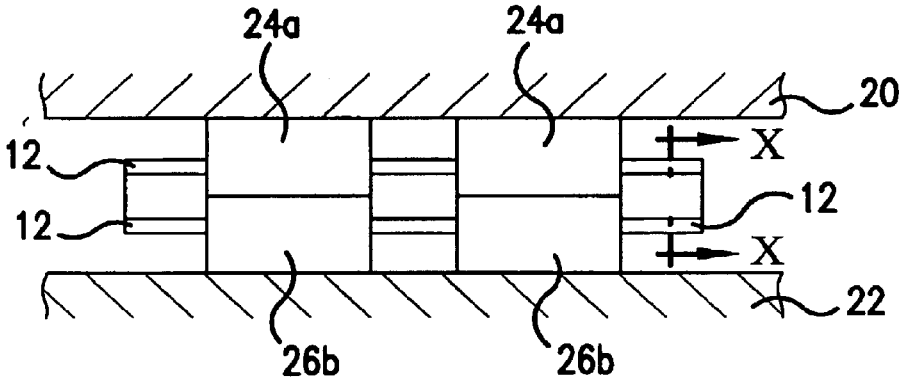
FIGS. 24A and 24B are partial sectional views of an example of a compression molding device for compressing long wood.

In the above described methods, the logs 10 whose length are longer than that of the compressing die set are produced by a plurality of dies, e.g., the upper die 24 and the lower die 26, are provided between the movable plate 20, which is capable of moving in the vertical direction, and the fixed plate 22 as shown in FIG. 24A.

Figure 24B:
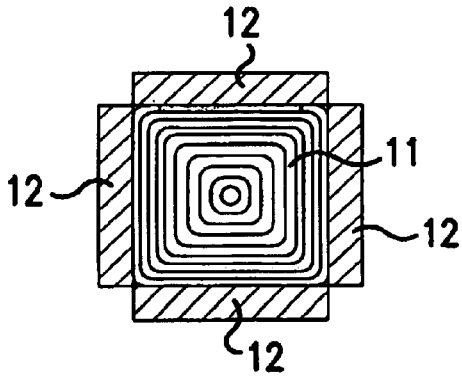

In the case of compression-molding by a plurality of dies, projected parts, which are projected outward from the dies, exist as shown in FIG. 24A. Compressing load of the dies can be transmitted to the projected parts by the metal plates 12, 12, . . . , so that the prismatic wood 11 can be formed as shown in FIG. 24B. The restraint jig, e.g., the band-shaped members 14 shown in FIG. 1C, etc., can be attached to the projected parts.

Figure 25A:
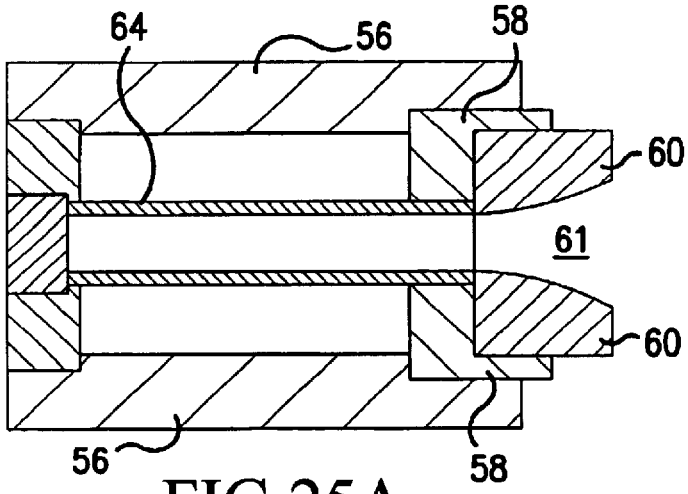
FIGS. 25A and 25B are partial sectional views of another compression molding device for compressing long wood.
Figure 25B:
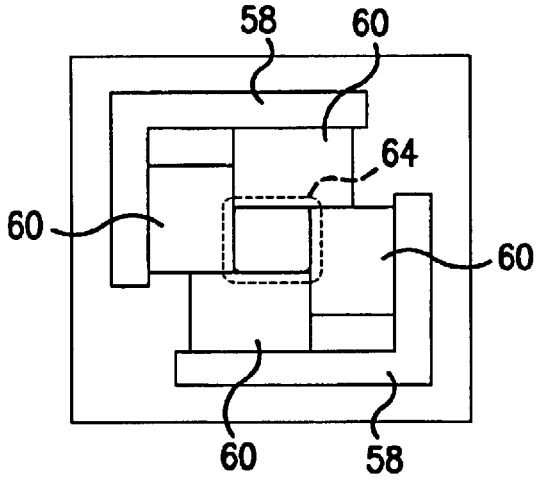

Further, a long log can be easily compression-molded by a device shown in FIGS. 25A and 25B. FIG. 25A is a longitudinal sectional view of the device; and FIG. 25B is a front view thereof.

In the device shown in FIGS. 25A and 25*b*, four clamping dies 60 is capable of moving along guide members 58 and 58, which are provided to a frame 56, and they constitute a hollow section 61 whose inner diameter is gradually reduced toward an inlet of the cylindrical die 64.

To insert compressed wood into the metallic cylindrical die 64 which is located on an outlet side of the hollow section 61, the cylindrical die 64 is provided to connect the outlet of the hollow section 61 to an inlet of the cylindrical die 64. A transverse sectional shape of the cylindrical die corresponds to that of the prismatic wood produced.

Figure 26:
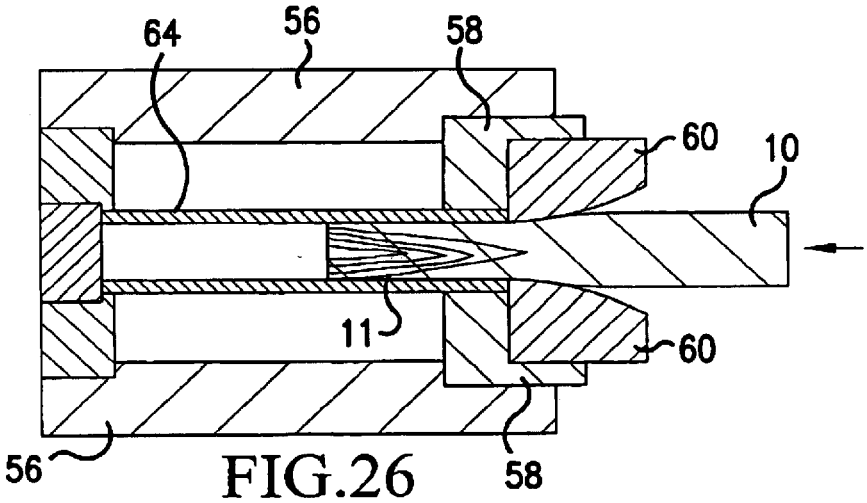
FIG. 26 is a sectional view of a state in which a log is compressed by the device shown in FIGS. 25A and 25B.

The method of compression-molding the log 10 by the device shown in FIGS. 25A and 25B will be explained with reference to FIG. 26.

The outer circumferential face of the log 10 is gradually compressed by an inner face of the hollow section 61 with moving the log 10 in a direction of an arrow, so that the log 10 is compression-molded into the prismatic wood 11. The compressed prismatic wood 11 is inserted into the cylindrical die 64 with maintaining its outer faces in the compressed state.

Figure 27A:
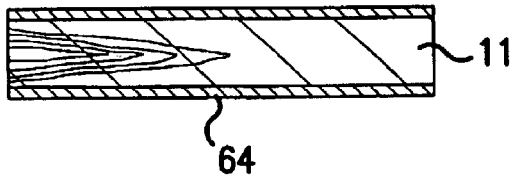
FIGS. 27A and 27B are sectional views of a cylindrical die in which the wood compressed by the device shown in FIGS. 25A and 25B is inserted.

The compressed state of the outer flat faces of the prismatic wood 11 in the cylindrical die 64 are restrained by the inner face of the cylindrical die 64. As shown in FIG. 27A, the cylindrical die 64 in which the compressed prismatic wood 11 is inserted is taken out from the device and heat-treated so as to permanently fix the compressed shape of the prismatic wood 11.

After the heat-treatment, the prismatic wood 11 is taken out from the cylindrical die 64, the prismatic lumber may be used as a prismatic pillar, etc.

Figure 27B:
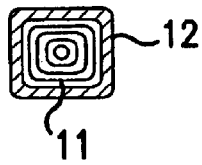

Note that, the transverse sectional shape of the cylindrical die 64 shown in FIG. 27B is the rectangular, but the cylindrical die 64 whose transverse sectional shape is hexagonal is used in the case of producing the prismatic wood 11 having the hexagonal sectional shape.

INDUSTRIAL APPLICABILITY

In the present invention, long prismatic lumber can be produced by compression-molding with low cost, and the prismatic lumber can be used building and construction materials.

Further, damaged wood, which was damaged by high wind, heavy snow, etc., can be effectively used, so the method contributes to a field of effective preservation of natural resources.

What is claimed is:

1. A prismatic wood compression molding method, in which wood is compressed by a compression molding die whose length is shorter than that of the wood, comprising the steps of:

opening said compression molding die;

setting said wood in said compression molding die with a plurality of rigid plate-like bodies, whose length is equal to or longer than that of the wood;

closing said compression molding die and compressing an outer circumferential face of wood throughout the length of said wood by said plurality of rigid plate-like bodies so as to form the wood into prismatic wood which is rectangular, hexagonal, or another polygonal shape in cross section;

restraining parts of said plate-like bodies, which compress a part of said wood projected from said compression molding die, by a restraining jig so as to hold flat surfaces of said prismatic wood in a state in which they are compressed by said plate-like bodies;

opening said compression molding die;

taking out said prismatic wood from said compression molding die together with said rigid plate-like bodies restrained by said jig; and applying a heat treatment to said prismatic wood held in the compressed state by said plate-like bodies and said jig so as to permanently fix the shape of said prismatic wood, wherein the plate-like bodies are metal plates.

2. The method according to claim 1, wherein said wood is compressed by a compression molding die set including an upper die and a lower die, which form a cavity, whose transverse sectional shape corresponds to that of said prismatic wood, when they are closed, and said plate-like bodies are arranged to contact corresponding inner faces of the cavity.

3. The method according to claim 1, wherein a plurality of said molding dies are used to compress the wood.

4. The method according to claim 1, wherein a gap is formed between said adjacent plate-like bodies.

5. The method according to claim 1, wherein a spacer is provided between said adjacent plate-like bodies before starting compression, the spacer is removed after starting the compression, then said wood is further compressed after removing the spacer.

6. The method according to claim 1, wherein said restraining jig is a band-shaped member having heat-resistivity, and the band-shaped member is capable of clamping outer faces of said plate-like bodies.

7. The method according to claim 1, wherein said restraining jig is a loop-shaped band member capable of clamping a part of the outer circumferential face of said wood which projects outward from said compression molding die set.

8. The method according to claim 1, wherein said restraining jig is a band-shaped member capable of clamping outer faces said plate-like bodies, said band-shaped member is provided in grooves of inner cavity faces of an upper die and a lower die.

9. The method according to claim 1, wherein said plate-like bodies have compressing sections for compressing corners of said prismatic wood.

10. The method according to claim 1, wherein said wood is hollow wood, and a mandrel is inserted in a hollow portion of said hollow wood while the compression and the heat treatment.

11. The method according to claim 1, wherein said wood is damaged wood having peeled portions, which are cracks or like formed by high wind or heavy snow, said peeled portions are fixed by bamboo nail, then said fixed wood is compressed and heat-treated.

12. The method according to claim 1, wherein patterns of projections or grooves are formed in pressing faces of said plate-like bodies.

13. A compression molding device for manufacturing compressed prismatic wood, comprising:

a compression molding die set having a length shorter than that of wood, said compression molding, die including an upper die and a lower die, which form a cavity, which is rectangular, hexagonal, or another polygonal shape when they are closed;

a plurality of plate-like bodies being set in said compression molding die, said plate-like bodies compressing an outer circumferential face of wood throughout the length thereof so as to form the wood into prismatic wood which is rectangular, hexagonal, or another polygonal shape in cross section; and a restraining jig wrapped around said plate-like bodies so as to hold flat surfaces of said prismatic wood in a state in which they are compressed, wherein the plate-like bodies are metal plates.

14. The device according to claim 13, wherein said restraining jig is a band-shaped member capable of clamping outer faces of said plate-like bodies.

15. The device according to claim 13, wherein said restraining jig is a loop-shaped band member.

16. The device according to claim 13, wherein said restraining jig is a band-shaped member provided in grooves of inner cavity faces of the upper die and the lower die.

17. The device according to claim 13, wherein said plate-like bodies have compressing sections for compressing corners of said prismatic wood.

18. The device according to claim 13, wherein patterns of projections or grooves are formed in pressing faces of said plate-like bodies.

19. The method according to claim 1, wherein said heat treatment is a dry heat treatment.

* * * * *